United States Patent [19]

Ireland

[11] Patent Number: 4,854,470

[45] Date of Patent: Aug. 8, 1989

[54] PAINT BRUSH HOLDER

[76] Inventor: Russ L. Ireland, 1335 N. 37th Place, Milwaukee, Wis. 53208

[21] Appl. No.: 245,043

[22] Filed: Sep. 16, 1988

[51] Int. Cl.[4] ..... B65D 25/00

[52] U.S. Cl. ..... 220/90; 206/361

[58] Field of Search ..... 220/90, 85 CH, 85 R, 220/1 C; 206/361

[56] References Cited

U.S. PATENT DOCUMENTS

| | | | |
|---|---|---|---|
| 2,748,977 | 6/1956 | Sarchet | 220/90 |
| 3,948,413 | 4/1976 | Gorrell | 220/90 |
| 4,014,453 | 3/1977 | Tarnacki | 220/90 |
| 4,145,789 | 3/1979 | Morgan, Sr. | 220/90 X |
| 4,164,299 | 8/1979 | Fuhr | 220/90 X |
| 4,275,818 | 6/1981 | Church | 220/90 |
| 4,436,217 | 3/1984 | Ritter | 220/90 X |
| 4,561,556 | 12/1985 | Bendix | 220/90 |
| 4,757,568 | 7/1988 | Jones | 220/90 X |

*Primary Examiner*—Steven M. Pollard

*Attorney, Agent, or Firm*—Andrus, Sceales, Starke & Sawall

[57] ABSTRACT

A multipurpose painting aid for use as a paint brush holder attachable to a paint tray as well as a portable, self-supporting, hand holdable receptacle for paint and paint brushes independent of the paint tray. The painting aid includes an open top receptacle, a scraper for removing excess paint from a paint brush disposed at the upper edge of the rear wall of the receptacle, and a pair of spaced apart brackets each including a pair of spaced apart legs projecting rearwardly from the rear wall to define a tray receiving slot therebetween for attaching the receptacle to a paint tray so that the scraper extends above and over the paint tray. The base of the receptacle and one of the legs of each bracket member are spaced apart suffiently to support the receptacle in an upright manner when detached from the paint tray.

6 Claims, 1 Drawing Sheet

PAINT BRUSH HOLDER

BACKGROUND OF THE INVENTION

The present invention relates to painting aids, and more particularly to a paint brush holder attachable to a paint tray.

Various types of devices are known for storing a paint brush for relatively short periods of time while painting. Such devices are desirable since a user's only alternative is to place the paint brush within a paint container wherein the handle of the paint brush contacts the lip of the paint container resulting in paint transferring to the brush handle and thereafter to a user's hand and wherein the bristles quickly become laden with paint and usually drip excess paint when painting is resumed. Alternately, a user may place the paint brush where the bristle ends are not in the paint, as for example, across the mouth of the paint container, resulting in the bristles becoming excessively dry and hard. Therefore, it is desirable to provide a device for holding or storing a paint brush for relatively short periods of time while painting.

Typically, paint trays are employed by a user on a ladder, and therefore it is desirable to avoid the need for climbing up and down the ladder each time a painter needs a different brush or for a small quantity of paint to be used where the work space is limited such as when painting window frames, trim, molding and the like. Thus, it would be desirable to provide a device which would be attachable to a paint tray rather than a paint can such as those illustrated in the above noted patents.

SUMMARY OF THE INVENTION

A multipurpose painting aid for use as a paint brush holder attachable to a paint tray as well as a portable, self-supporting, hand holdable receptacle for paint and paint brushes independent of the paint tray.

The painting aid includes an open top receptacle having a base, a front wall, a rear wall inclined on an acute angle with respect to the front wall, and opposite side walls interconnecting the front wall, rear wall and base to form the receptacle for holding a paint brush. Each of the upper walls includes an upper edge which forms the open top of the receptacle. A scraper means is disposed at the upper edge of the rear wall for the removal of excess paint from a paint brush. The receptacle includes bracket means on the rear wall for removably attaching the receptacle to a paint tray. The bracket means includes a pair of spaced apart legs projecting rearwardly from the rear wall and inclined at an acute angle with respect to the rear wall which define a tray receiving slot therebetween for attaching the receptacle to a paint tray so that the scraper means extends above and over the paint tray. The base and one of the legs of the bracket means are spaced apart sufficiently to support the receptacle in an upright manner when detached from a paint tray.

Preferably, the scraper means comprises a flange integral with and extending rearwardly from the upper edge of the rear wall. Also, in one preferred form, the rear wall of the receptacle is inclined at an angle of about 10° with respect to the front wall, and the legs of the bracket means are inclined at an angle of about 45° with respect to the rear wall.

The present invention thus provides a new and improved paint brush holder that may be removably attached to a paint tray utilizing a simple bracket attachment. The painting aid of the present invention is durable in construction, easy to use and readily affordable since it lends itself to mass production techniques.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
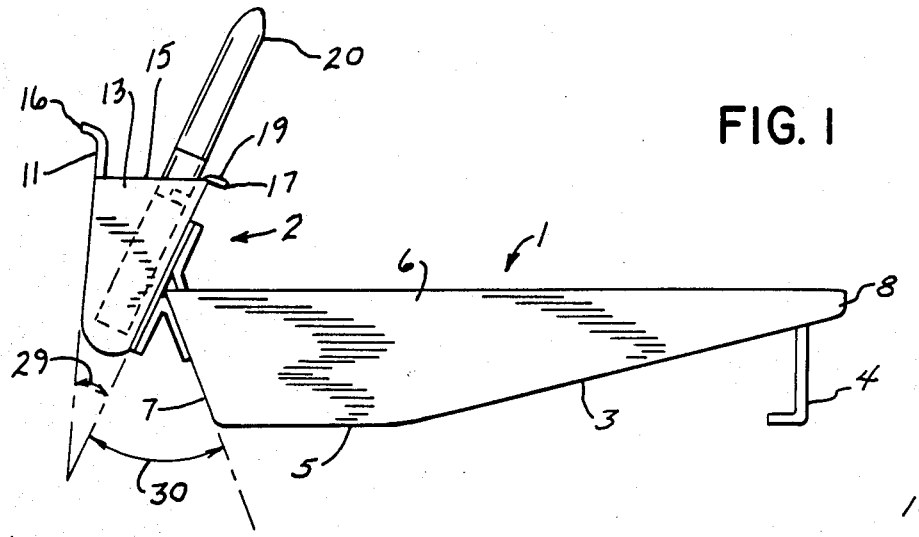
FIG. 1 is a side view in elevation illustrating a paint tray with a paint brush holder attached thereto constructed in accordance with the present invention.

Referring now to the drawings, FIG. 1 illustrates a paint tray generally designated by the numeral 1 incorporating a paint brush holder generally designated by the numeral 2 constructed in accordance with the principles of the present invention. Tray 1 is of the type typically employed with a paint roller (not shown) and is of a conventional design, with a sloping bottom wall 3 supported at its high end by a pair of spaced apart legs 4 and its lower end merging into a horizontal base portion 5. Bottom wall 3 and base 5 are enclosed by side walls 6, front wall 7 and rear wall 8 to form a paint receiving chamber 9 therebetween. As illustrated, holder 2 is preferably removably attachable to front wall 7 of tray 1.

Figure 2:
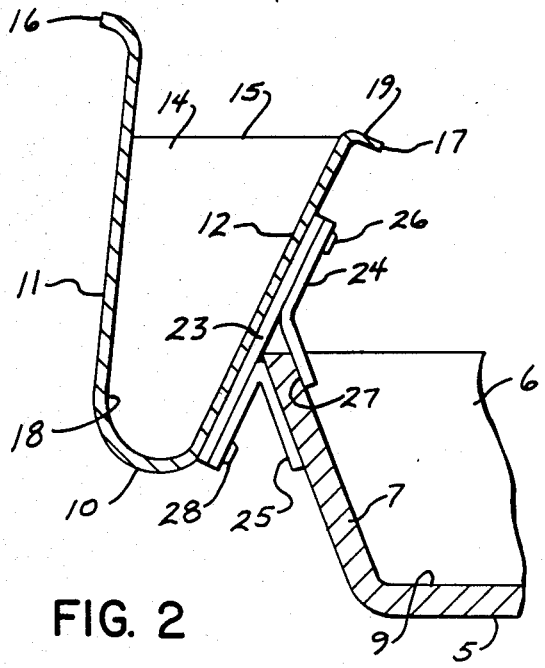
FIG. 2 is a fragmentary cross sectional side view in elevation illustrating the attachment of the paint brush holder to a paint tray.
Figure 3:
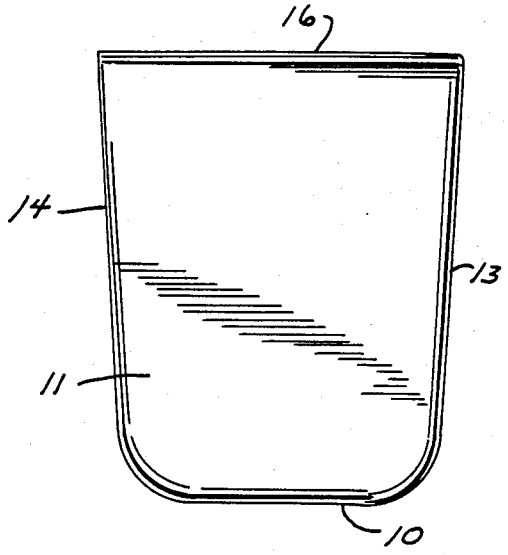
FIG. 3 is a front view in elevation of the paint brush holder of FIG. 1.

Holder 2 comprises an open top receptacle having a base 10, a front wall 11, a rear wall 12 and opposite side walls 13, 14. Holder 2 may be comprised of sheet metal or alternately may be molded from a synthetic plastic material. Rear wall 12 is inclined at an acute angle with respect to front wall 11 and as shown best in FIG. 1 this acute angle represented in FIG. 1 by arrow 29 is preferably about 10°. Side walls 13, 14 each include an upper edge 15 while front wall 11 includes an upper edge 16 and rear wall 12 includes an upper edge 17 which define the periphery of the open top for holder 2. As shown best in FIGS. 2–4, the lower edges of walls 11–14 are secured to and integral with base 10 to form a brush receiving chamber 18. The interior bottom of brush receiving chamber 18 includes rounded corners to provide ease of cleaning when finished painting.

A flange 19 is integral with and extends rearwardly from the upper end of rear wall 12. Flange 19 includes edge 17 and functions as a scraper for the removal of excess paint from a paint brush. Flange 19 and edge 17 are disposed over and above chamber 9 of tray 1 so that excess paint removed from brush 20 drips into chamber 9 rather than flowing down the outer surface of rear wall 12. Flanges 16 and 19 can be used as handles to lift device 2 off paint tray 1 so that holder 2 may be used as a portable hand held receptacle for paint and paint brushes when desired.

Figure 4:
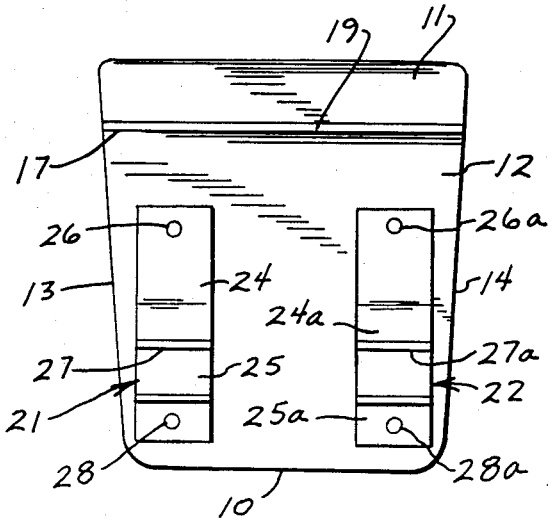
FIG. 4 is a rear view in elevation of the paint brush holder of FIG. 1.

In order to properly position flange 19, holder 2 includes a pair of spaced apart bracket members 21, 22 each disposed adjacent opposite sides of rear wall 12, as best shown in FIG. 4. Each bracket member 21, 22 are identical in structure, and therefore only bracket member 21 will hereinafter be described with the subscript "a" utilized for corresponding elements in connection with bracket member 22. Bracket member 21 includes a thin, narrow base plate 23 which abuts against the outer surface of rear wall 12 together with an upper leg 24 and a lower leg 25. Upper leg 24 has the same width as base plate 23 and includes an upper portion extending parallel to base plate 23 and rear wall 12, and a lower portion projecting rearwardly and downwardly from rear wall 12 and base plate 23. Upper leg 24 is mounted to rear wall 12 by means of a fastener 26 such as a screw, rivet or the like which passes through the upper portion of leg 24, the upper end of base plate 23 and into rear wall 12. Lower leg 25 has the same width as base plate 23 and is substantially V-shaped. Leg 25 includes a first portion extending parallel to base plate 23 in rear wall 12, and a second portion projecting rearwardly and downwardly from base plate 23 and rear wall 12. The lower portions of legs 24 and 25 extend parallel to one another and are spaced apart a sufficient distance to define a tray receiving slot 27 therebetween. Slot 27 is dimensioned to substantially correspond to the thickness of front wall 7 of tray 1, as shown best in FIG. 2, so as to eliminate unnecessary "play" when attached thereto. Lower leg 25 is secured to base plate 23 and rear wall 12 by means of a fastener 28 such as a screw, rivet or the like passing through the lower portion of leg 25, the lower end of base plate 23 and into rear wall 12. As best shown in FIG. 1, the angle of inclination represented in FIG. 1 by arrow 30 for the lower portions of legs 24 and 25 with respect to rear wall 12 is about 45°. At this angle, holder 2 is positioned so that flange 19 extends sufficiently over and above chamber 9 of tray 1. Also, this angle of inclination for legs 24 and 25 provide for the lower edge of the lower portion of leg 25 to be spaced from base 10 of holder 2 thereby permitting holder 2 to be supported in an upright manner by means of leg 25 and base 10 when holder 2 is detached from a paint tray. Thus, holder 2 may be employed as a separate and independent paint container if desired where the available work space is limited such as when painting window frames, trim, molding and the like. Thus, the overall dimensions of holder 2 are such that it may be readily portable and hand holdable if desired.

A multipurpose painting aid for use as a paint brush holder attachable to a paint tray as well as a portable, self-supporting, hand holdable receptacle for paint and paint brushes independent of the paint tray has been illustrated and described. Various modifications and/or substitutions of the specific components described herein may be made without departing from the scope of the present invention. For example, materials of construction may vary depending upon their cost and availability.

Various modes of carrying out the invention are contemplated as being within the scope of the following claims particularly pointing out and distinctly claiming the subject matter regarded as the invention.

I claim:

1. A multipurpose painting aid for use as a paint brush holder attachable to a paint tray as well as a portable, self-supporting, hand holdable receptacle for paint and paint brushes independent of said paint tray, comprising:

an open top receptacle having a base, a front wall, a rear wall inclined at an acute angle with respect to said front wall, and opposite side walls interconnecting said front wall, rear wall and base to form said receptacle for holding a paint brush, each of said walls includes an upper edge to form said open top;

scraper means disposed at the upper edge of said rear wall for the removal of excess paint from a paint brush; and bracket means on said rear wall for removably attaching said receptacle to a paint tray, said bracket means includes a pair of spaced apart legs projecting rearwardly from said rear wall and inclined at an acute angle with respect to said rear wall, said legs defining a tray-receiving slot therebetween for attaching said receptacle to a paint tray so that said scraper means extends above and over a paint tray, and said base and one of said legs being spaced apart sufficiently to support said receptacle in an upright manner when detached from a paint tray.

2. The painting aid of claim 1 wherein said scraper mens comprises a flange integral with and extending rearwardly from the upper edge of said rear wall.

3. The painting aid of claim 1 wherein said rear wall is inclined at an angle of about 10°, and said legs are inclined at an angle of about 45°.

4. The painting aid of claim 1 wherein said bracket means comprises a pair of bracket members each having a pair of spaced apart projecting legs.

5. The painting aid of claim 4 wherein said one leg of each bracket member projects further from said rear wall than the other leg.

6. The painting aid of claim 5 wherein said one leg of each bracket member is substantially V-shaped.

* * * * *